US006318620B1

(12) United States Patent
Anstett et al.

(10) Patent No.: US 6,318,620 B1
(45) Date of Patent: Nov. 20, 2001

(54) RATCHETTING MANUAL NAILER

(75) Inventors: David A. Anstett, Algonquin; Richard S. Moscato, Wheeling, both of IL (US)

(73) Assignee: Powernail Co., Loncolnshire, IL (US)

( * ) Notice: Subject to any disclaimer, the term of this patent is extended or adjusted under 35 U.S.C. 154(b) by 0 days.

(21) Appl. No.: 09/387,408

(22) Filed: Sep. 2, 1999

(51) Int. Cl.[7] ..... B25C 1/04
(52) U.S. Cl. ..... 227/147; 227/148
(58) Field of Search ..... 227/147, 148, 227/149, 142, 110, 134, 151; 173/90, 121, 31

(56) References Cited

U.S. PATENT DOCUMENTS

| | | | | |
|---|---|---|---|---|
| Re. 29,354 | | 8/1977 | Malkin | 227/132 |
| 406,075 | | 7/1889 | White | 227/134 |
| 1,158,430 | * | 11/1915 | Bell | 227/147 |
| 2,078,012 | * | 4/1937 | Newell | 173/31 |
| 2,097,865 | * | 11/1937 | Stockel | 227/134 |
| 2,229,868 | * | 1/1941 | Newell, Sr. | 227/147 |
| 2,458,259 | | 9/1949 | Anstett | 85/21 |
| 2,649,831 | | 8/1953 | Anstett | 85/21 |
| 2,768,376 | * | 10/1956 | Critchley | 173/31 |
| 2,822,544 | * | 2/1958 | Anstett | 227/148 |
| 2,866,199 | * | 12/1958 | Freeman et al. | 173/121 |
| 2,868,057 | | 1/1959 | Anstett | 85/30 |
| 2,994,878 | * | 8/1961 | Abrahamsen | 227/147 |
| 3,007,171 | * | 11/1961 | Critchley | 227/147 |
| 3,022,509 | * | 2/1962 | De Man | 227/147 |
| 3,042,925 | * | 7/1962 | Frostad et al. | 227/134 |
| 3,281,046 | * | 10/1966 | Boulay | 227/147 |
| 3,360,176 | * | 12/1967 | Gehl et al. | 227/148 |
| 4,204,625 | | 5/1980 | Glenn | 227/76 |
| 4,907,730 | | 3/1990 | Dion | 227/8 |

* cited by examiner

*Primary Examiner*—Scott A. Smith
(74) *Attorney, Agent, or Firm*—Wallenstein & Wagner, Ltd.

(57) ABSTRACT

A nailer is disclosed having a plunger wherein a user can incrementally drive a fastener into a workpiece by manually striking the plunger multiple times. Generally, the nailer includes a housing having a chamber adapted to receive at least one fastener and a driving blade. Operably connected to the housing and the driving blade is a plunger having a plurality of teeth. Received between at least two of the teeth is a pawl. Further, a recoil spring is operably connected to the housing and the plunger.

24 Claims, 7 Drawing Sheets

RATCHETTING MANUAL NAILER

DESCRIPTION

1. Technical Field

The present invention generally relates to nailers for driving fasteners into workpieces, and in particular, to a nailer having a plunger wherein a user can incrementally drive a fastener into a workpiece by manually striking the plunger multiple times.

2. Background Art

Fasteners stamped or blanked from cold rolled steel sheets and formed into sticks or strips for continuous or magazine feeding of a plunger-type nailing machine are well known in the art. Examples of such fasteners are exemplified in U.S. Pat. Nos. 2,649,831; 2,868,057, and 2,428,259, the disclosures of which are incorporated in their entirety by reference herein. Such fasteners, more commonly termed cleats or nails, can be used to install tongue and groove flooring and other types of workpieces.

Plunger-type nailing machines for driving fasteners into workpieces can be divided into two general categories: manually operated and power assisted. Typically, a manually operated nailing machine includes a plunger extending from the housing of the nailing machine. The plunger includes a head suitable for striking with a heavy mallet. A recoil spring is used to resiliently bias the plunger head at a distance away from the nailer housing. In use, a fastener is driven into a workpiece by striking the plunger head with a mallet. The application of such force results in compression of the spring as the fastener is being driven into the workpiece. The spring then recoils the plunger head back to its initial position away from the housing of the nailer.

In using the above described manual nailing machines, problems occur if the user does not strike the plunger with adequate force to fully drive the fastener into the workpiece. For instance, to drive a partially driven fastener the rest of the way into the workpiece, the user must again apply enough force to the plunger head to recompress the recoil spring. Accordingly, recompressing the recoil spring several times over the course of job can cause a user to become prematurely exhausted.

The prior nailing machines also continue to load another fastener for driving into a workpiece even if a preceding fastener was not completed driven into the workpiece. Consequently, these nailing machines cannot be used to complete the process of driving partially driven fasteners into the workpiece. Instead, the user must take special time-consuming steps, such as using a punch or the like, to finish driving partially driven fasteners into the workpiece.

Hence, prior to the present invention, a need existed for a manual nailer that allows a user to incrementally drive a fastener into a workpiece without wasting time or energy.

SUMMARY OF THE INVENTION

According to the present invention, a manual nailer has been developed wherein a user can incrementally drive a fastener into a workpiece by striking a plunger multiple times. As a result, the user does not have to strike the plunger with enough force to drive the fastener into the workpiece with a single blow.

Generally, the nailer machine of the present invention includes a housing having a chamber adapted to receive at least one fastener and a driving blade. Operably connected to the housing and the driving blade is a plunger having a plurality of teeth. Received between at least two of the teeth is the pawl of a ratchetting mechanism. Further, a recoil spring is operably connected to the housing and the plunger.

Other advantages and features of the present invention will be apparent from the following description of a specific embodiment illustrated in the accompanying drawings.

DETAILED DESCRIPTION

Figure 1:
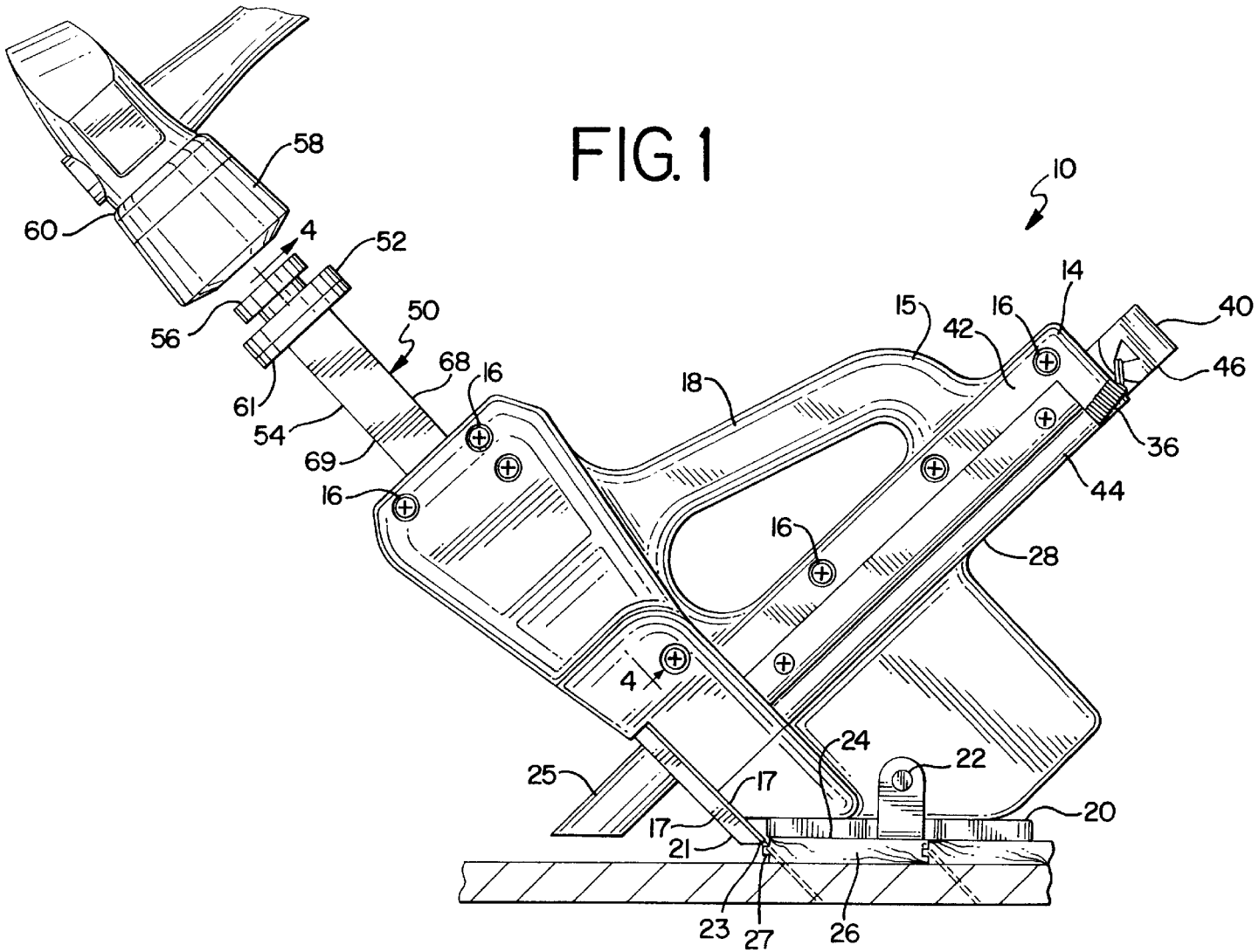
FIG. 1 is a side view of a nailer in accordance with the present invention having a housing with a plunger extending therefrom.

While this invention is susceptible of embodiments in many different forms, there is shown in the drawings and will herein be described in detail a preferred embodiment of the invention. The present disclosure is to be considered as an exemplification of the principles of the invention and is not intended to limit the broad aspect of the invention to the embodiment illustrated.

Figure 2:
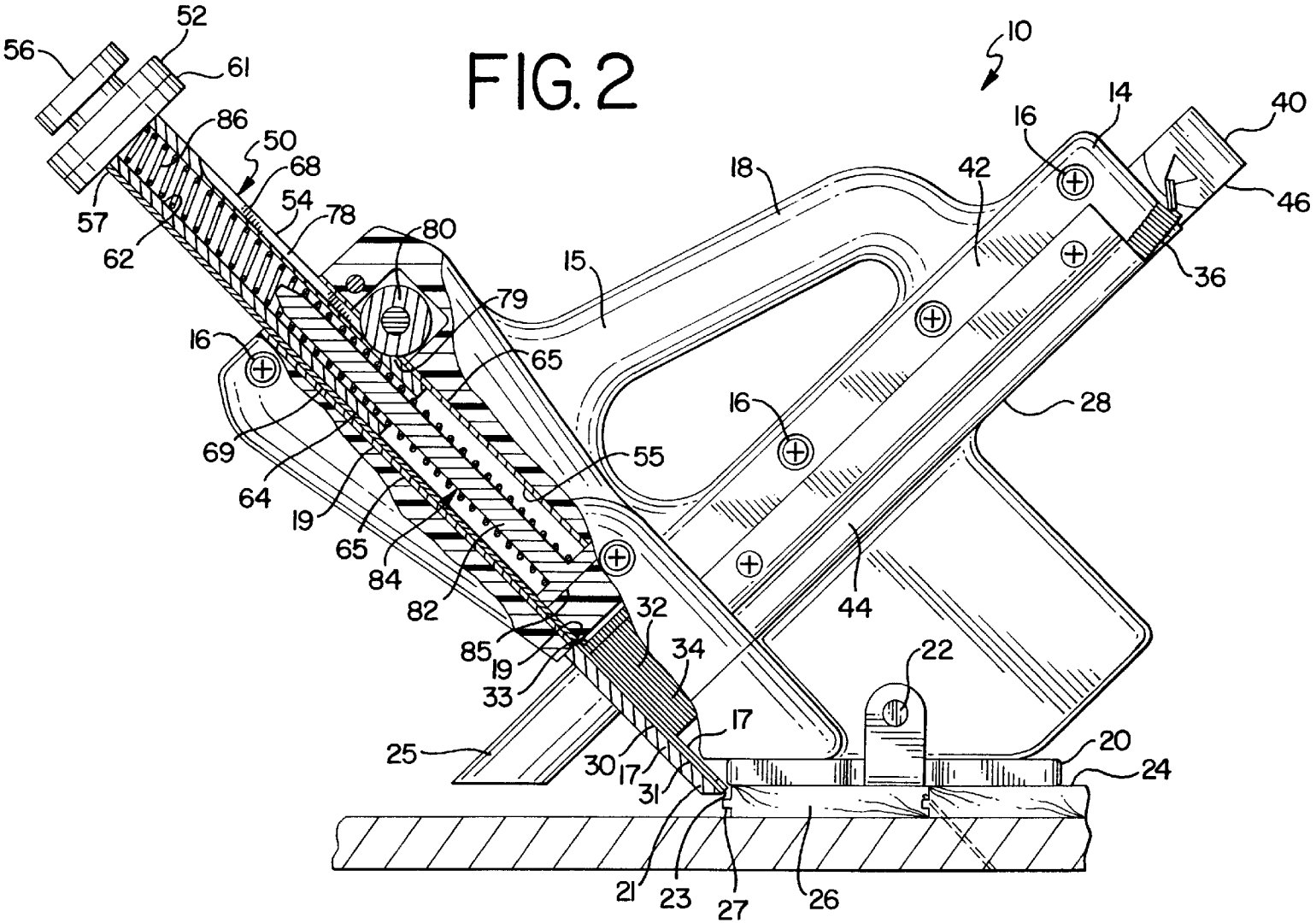
FIG. 2 is a partial fragmentary view of the nailer of FIG. 1.
Figure 3:
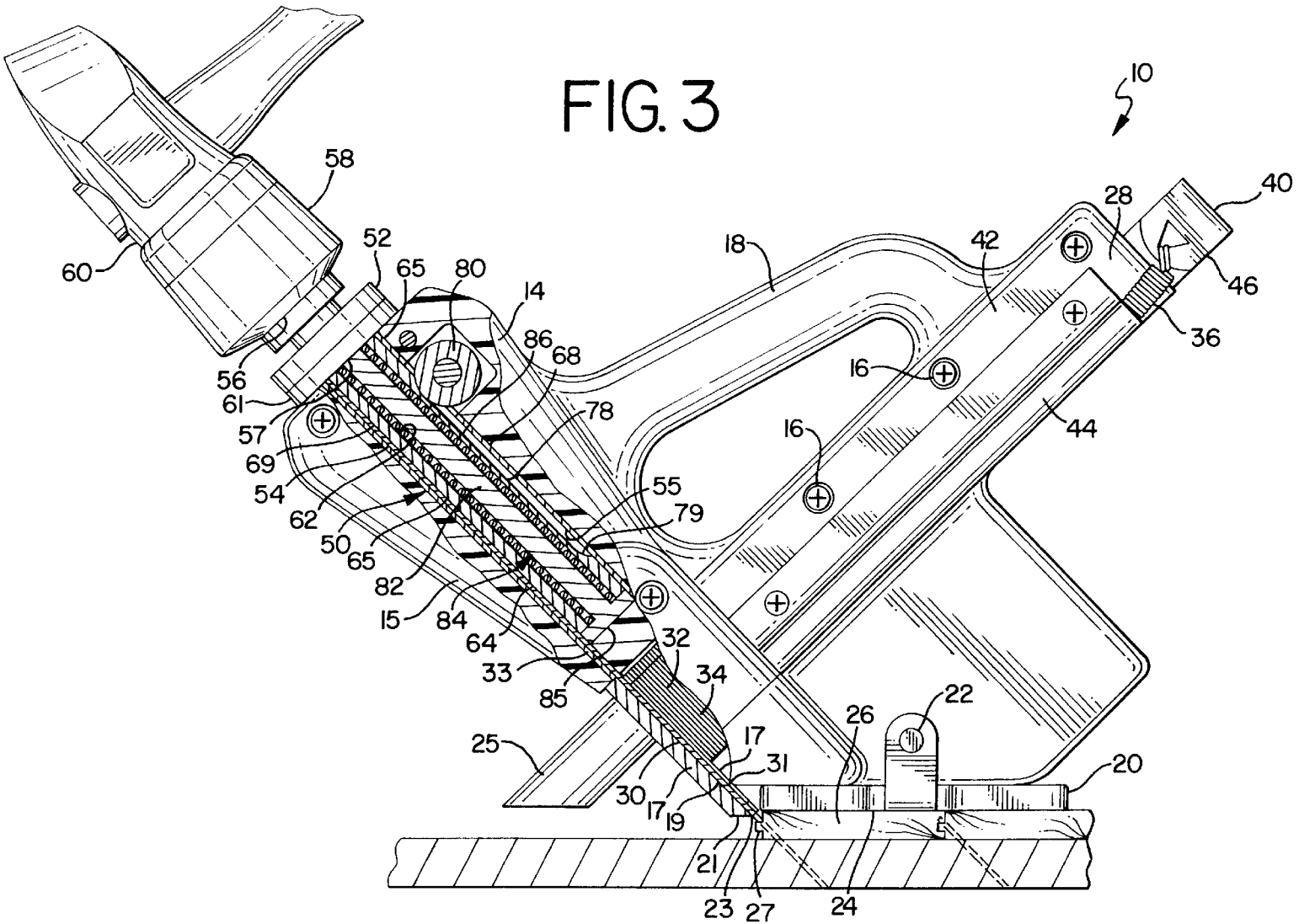
FIG. 3 is a partial fragmentary view of the nailer of FIG. 1 with the plunger fully driven into the housing by a mallet.

Referring now to the drawings, and particularly to FIGS. 1–3, a nailer 10 is disclosed having a rachet mechanism 12 (FIGS. 4–7) for preventing the return of a partially driven plunger. The nailer 10 includes a housing 14 made of two generally symmetrical reinforced thermoset plastic halves 15 (only one half shown), or the like, and held together by rivets, screws, bolts 16 threaded onto nuts, or other conventional means. The housing 14 defines an integral handle 18 wherein, if desired, a conventional handle extension (not shown) can be attached.

The housing 14 also includes a base cap 17 constructed of two plates of metal or metal alloy attached to each other and attached to the two halves 15 of the housing by conventional means such as rivets or the like. The base cap 17 defines a nose 21 having an opening 23. Attached to the base cap 17 is a front foot 25 for maintaining the nailer 10 in an upright position (i.e., a position similar to that shown in FIGS. 1 and 2) when the nailer is placed on a planar surface.

Attached to the bottom of the housing 14 is a user removable plate or rear foot member 20. Preferably, the rear foot 20 is attached to the housing 14 by a conventional pin assembly comprising a pin 22 that can be removed and reinstalled by a user.

During use of the nailer 10, described in detail further herein, the rear foot 20 preferably sits on the upper surface 24 of a flooring workpiece 26. The foot 20 elevates the nailer 10 by a predetermined distance above the upper surface 24 of the flooring workpiece 26. Accordingly, a user can adjustably elevate the nailer above the flooring workpiece 26 by a desired distance by attaching a corresponding foot member to the nailer 10. Likewise, the nose 21 of the nailer 10 can be adjustably positioned about the tongue 27 of a flooring workpiece 26.

Turning to FIG. 2, the housing 14 defines a magazine 28 and a chamber 30. The chamber 30 is defined by the base cap 17 and is in fluid communication with the opening 23 in the nose 21 of the base cap via a passageway 31.

The magazine 28 provides for receiving a plurality of fasteners 32. In an embodiment, the magazine 28 consists of an elongated channel 34 that is generally L-shaped in vertical cross-section and is in fluid communication with the chamber 30. If desired to reduce fictional wear on the housing, the channel 34 can be fully or partially lined with a protective metal or metal alloy sheath. The magazine 28 also has an opening, opposite the chamber 30, for receiving fasteners.

Attached to the housing 14 is a follow spring 36 coupled to a feeder bar 40. The follow spring 36 is mounted on the outside 42 of the housing 14 and is generally in spaced parallel relationship to the magazine channel 34. Preferably, a portion of the follow spring 36 is covered by a metal or metal alloy protective shield 44 attached to the outside 42 of the housing 14.

The feeder bar 40 has a proximal end 46 and a distal end (not shown). The proximal end 46 is attached to the follow spring 36 and the distal end is adapted to be received within the opening 48 of the channel 34 and slide freely within the channel 34. When fasteners 32 are loaded within the channel 34 of the magazine 28, the follow spring 36 brings the feeder bar 40 into pressing engagement against the last fastener feed into the magazine 28. This forces the fasteners 32 to be feed into the chamber 30 in a serial manner during operation of the nailer 10 as explained in detail further herein.

Extending from the housing 14 is a plunger 50 having a head portion 52 and a shank portion 54 integrally connected together. Preferably, the plunger 50 is constructed of a metal or a metal alloy. The head portion 52 provides a generally large annular surface 56 suitable for striking with the rubber end 58 of a metal or metal alloy weighted mallet head 60. The distal end 64 of the shank 54 is received within an elongated cavity 55 defined within the housing 14. Preferably, the cavity 55 is generally in perpendicular spaced relationship to the magazine channel 34 and the cavity is rectangular in vertical cross section. Moreover, to reduce frictional wear on the housing, the cavity 55 is lined with a protective metal or metal alloy sheath 65.

The shank portion 54 of the plunger 50 is generally rectangular in vertical cross section with a cylindrical open bore 62 longitudinally extending within the shank. Preferably, the bore 62 and the shank 54 are in longitudinal coaxial alignment with each other.

Mounted around the shank portion 54 and about the head portion 52 is a rubber donut shock absorber and blade retainer 61. The donut 61 prevents the head 52 of the shank 50 from striking the housing 14 as the plunger head is driven towards the housing and holds the driving blade 19 in place.

The outer surface of the shank 54 includes a toothed side 66 and a longitudinally grooved side 68. The toothed side 66 of the shank 54 is perpendicular to the grooved side 68 and includes a plurality of teeth 70 defined by corresponding lateral grooves 72 in the shank. The teeth 70 are positioned between a pair of release notches 74 and 76 formed in the shank's toothed side 66. Preferably, notch 74 is formed proximate to or at the middle of the shank 54 and notch 76 is formed proximate to the distal end 64 of the shank, respectively.

The grooved side 68 of the shank 54 includes a longitudinal groove 78 having an end or stop 79. Received within the groove 17 is a portion of a roller 80 for fixedly reciprocally mounting the shank 54 to the housing 14. In particular, the roller 80 is rotatably mounted to the housing by a fixed shaft 8. As the shank 54 is extended from the housing cavity 55, the roller 80 abuts the stop 79 to prevent the distal end 64 of the shank 54 from exiting the cavity 55 as shown in FIG. 2.

Received within the open bore 62 of the plunger shank 54 is the stem 82 of a spring support pin 84 made of a metal or metal alloy. The pin 84 also includes a head 85 integrally connected to the stem 82. The head 85 of the pin 84 abuts the housing 14 within the cavity 55.

Also received within the open bore 62 of the plunger shank 54 is a coil spring 86 for recoiling the head portion 52 of the plunger 50 away from the housing 14. A portion of the coil spring 86 wraps about the stem 82 of the support pin 84 with the coil spring and the pin in coaxial alignment with each other. Further, the two ends of the coil spring 86 abut the head 85 of the support pin 84 and the head portion 52 of the plunger 50, respectively.

The housing 14 defines a containment cavity 88 for containing the rachet mechanism 12 including a planar spacer 87 and a retaining member 89 comprising a metal alloy ring. The containment cavity 88 is in fluid communication with the housing cavity 55 that receives the shank 54 of the plunger 50.

Operably attached to the retaining member 89 is a bias spring 90 and a stop ring 92. The bias spring 90 includes a coil spring 93 having a pair of tines or arms 94,95 integrally extending from each end of the coil spring. The coil spring wraps about a stationary mounting post 96 mounted to the retaining member 89. Also mounted to the retaining member 89 and received between the arms 94,95 of the bias spring 90 is a stop or post 97.

The ring 92 is pivotally mounted to a stationary mounting post 91 attached to the retaining member 89 such that the post extends through an aperture in the ring 92. Radially extending from the ring 92 is a pawl 98 and a detent 99. The pawl 98 and the detent 99 are generally in spaced perpendicular relationship to each other with the detent 99 received between the arms 94,95 of the bias spring 90. Further, the pawl 98 extends into the housing cavity 55 that receives the shank 54 of the plunger 50.

Attached to the plunger 50 in a conventional manner is an elongated driving blade 19 for driving a fastener from the housing chamber 30 and into a workpiece 26. The driving blade is made of a metal or metal alloy. The blade 19 is removably mounted about the head 52 of the plunger 50. Preferably, the blade 19 has a generally T-shaped attachment head 57 received within a like shaped channel in the plunger shank 54. The attachment head 57 is maintained in the plunger channel by donut 61.

The blade 19 extends within a longitudinal groove within the shank side 69 which is opposite of the shank side 68. The blade 19 extends into the housing cavity 55 and a passageway 33 within the housing 14.

Accordingly, the blade passageway 33 is in fluid communication with the housing cavity 55 and the chamber 30. Moreover, the blade passageway 33 is preferably in spaced perpendicular relationship with the fastener magazine 28.

In use, the rear foot 20 of the nailer 10 is placed against the upper surface 24 of a flooring workpiece 26 while, simultaneously, the nose 21 of the base cap 17 is placed about the tongue 27 of the workpiece. The user then sharply strikes the top surface 56 of the shank head 52 with the rubber portion 58 of the mallet. This results in the shank 54 of the plunger 50 retracting into the nailer housing 14 while, simultaneously, the attached blade 19 drives a fastener from the nailer chamber 30 and into the flooring workpiece 26 via the opening 23 in the nailer nose 21. In an embodiment, the fastener is driven into the flooring 26 at an angle of about forty-five degrees relative to the subfloor 29.

Figure 5:
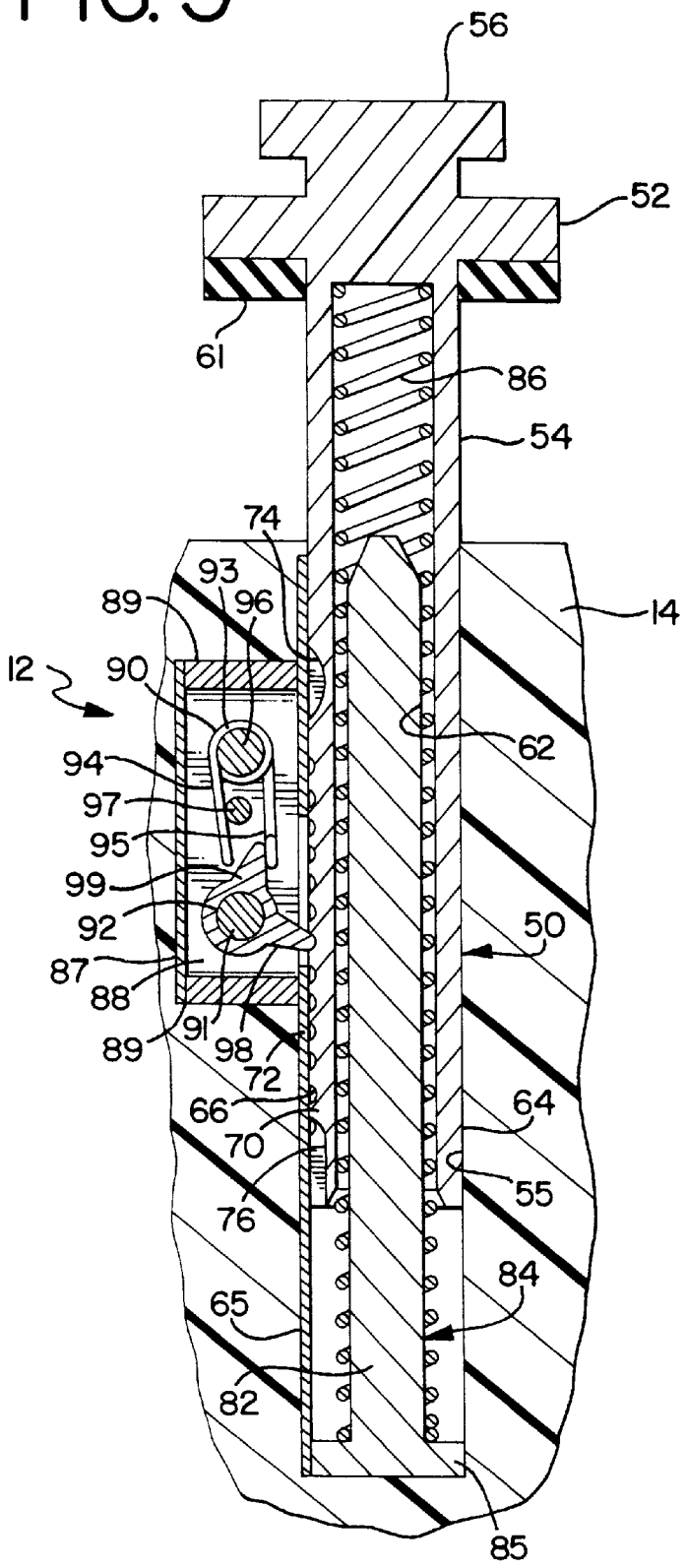
FIG. 5 is a cross sectional view similar to FIG. 4, but with the plunger partially driven into the housing and prevented from returning by a ratchet mechanism.

Turning to FIG. 5, as the shank 54 of the plunger 50 retracts into the housing 14, the pawl 98 of the ratchetting mechanism 12 serially engages and slides over the teeth 70 of the shank 54 and into the lateral grooves 72 therebetween. In particular, the pawl 98 is pressed against the shank 54 as a result of the arms 94,95 of the bias spring 90 resiliently engaging both the stop post 97 and the detent 99. The resistance provided by the arms 94,95 as they are separated further from each other results in the same force being applied in the pressing of the pawl 98 against the shank 54 of the plunger 50.

Moreover, if the plunger 50 is only partially driven into the housing 14, the pawl 98 engages one of the teeth 70 to prevent the plunger for recoiling back from the housing as a result of the coil spring 86 being partially compressed. The engagement of the pawl 98 prevents both the coil spring 86 from decompressing and another fastener from loading into the chamber 30 since the chamber is at least partially occupied by the driving blade 19 as shown in FIG. 3.

Figure 6:
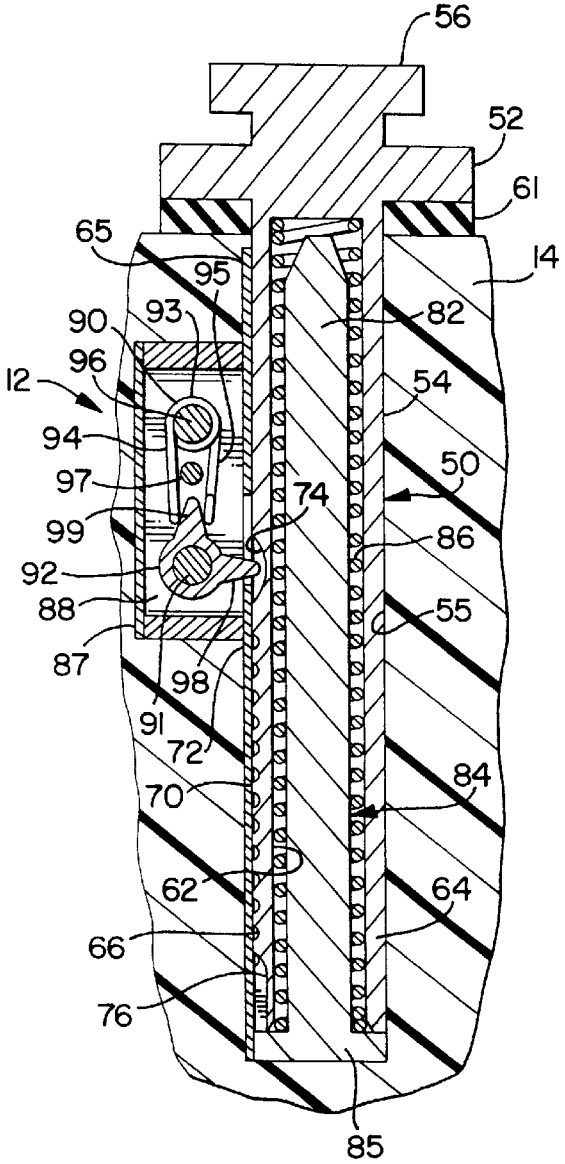
FIG. 6 is a cross sectional view similar to FIG. 4, but with the plunger fully driven into the housing.

Once the fastener 26 is fully driven into the workpiece 26 and into the subfloor 29 by the driving blade 19, the pawl 98 enters the release notch 74 in the shank 54 whereby the pawl no longer engages the shank as shown in FIG. 6. Accordingly, the bias spring 90 pivots the pawl 98 about the stop ring 92 to a neutral position as shown in FIG. 6.

Figure 7:
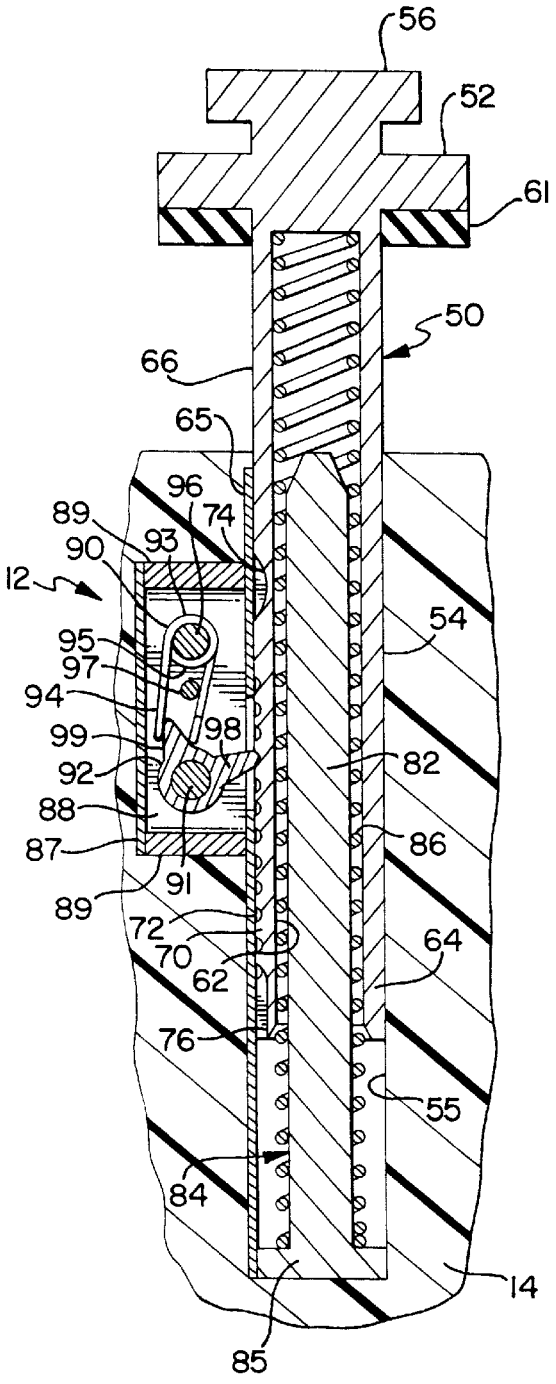
FIG. 7 is a cross sectional view similar to FIG. 4, but with the plunger in the process of returning from the housing; and, FIG. 8 is a partial fragmentary view of an alternative embodiment of a nailer in accordance with the present invention.

When the pawl 98 is at the neutral position, the coil spring 86 is allowed to decompress wherein, by the spring pushing against the plunger shank 54, the plunger's head portion 52 is extended away from the housing 14 as shown in FIG. 7. Simultaneously, the pawl 98 of the ratchetting mechanism 12 slides over the teeth 70 of the shank 54, without engaging the teeth 70, as the shank is extending away from the housing 14. Thus, the spring 86 recoils the plunger 54 to an initial position shown in FIG. 4.

Figure 4:
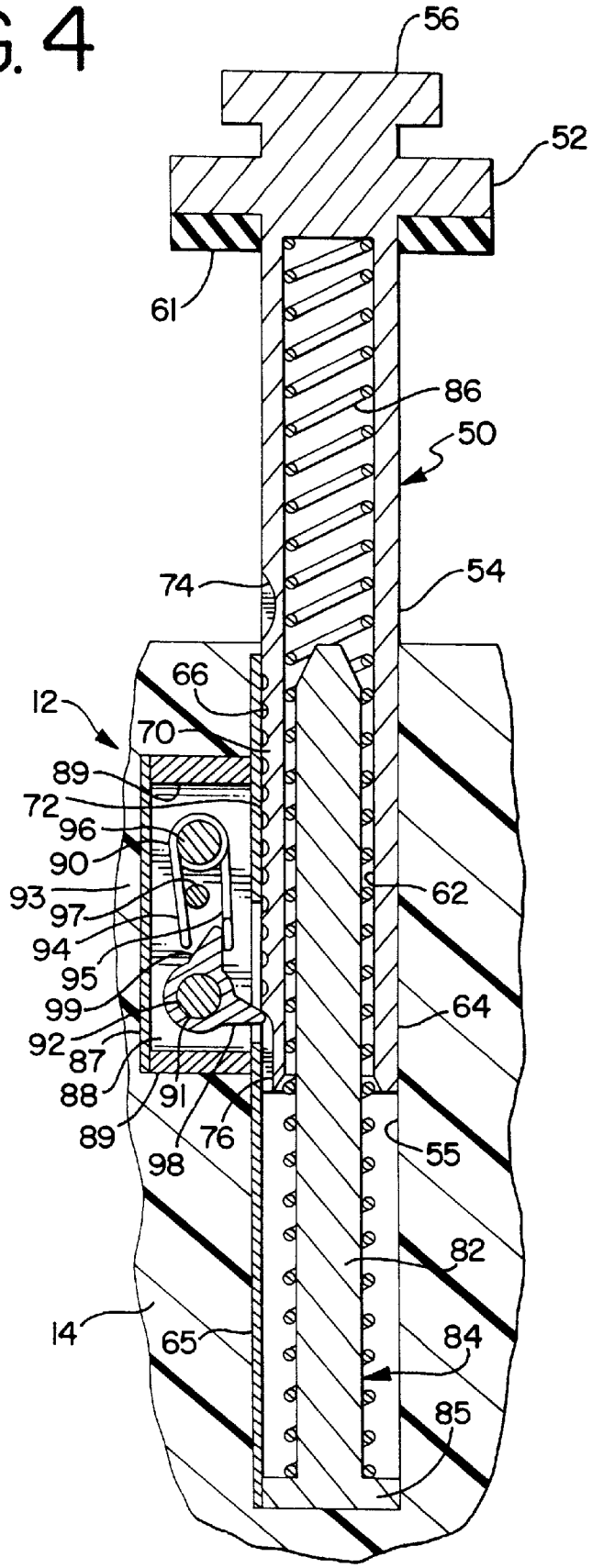
FIG. 4 is a cross sectional view along plane 4—4 of FIG. 1 depicting the plunger extending from the housing.

In the initial position shown in FIGS. 2 and 4, the pawl 98 projects into the release notch 76. Accordingly, the bias spring 90 pivots the pawl 98 to a neutral position that allows for the shank 54 of the plunger 50 to be driven back into the nailer housing 14. Further, the driving blade 19 is withdrawn from the housing chamber 30 in the initial position to allow another fastener to be pushed into the chamber for driving into the flooring 26.

Figure 8:
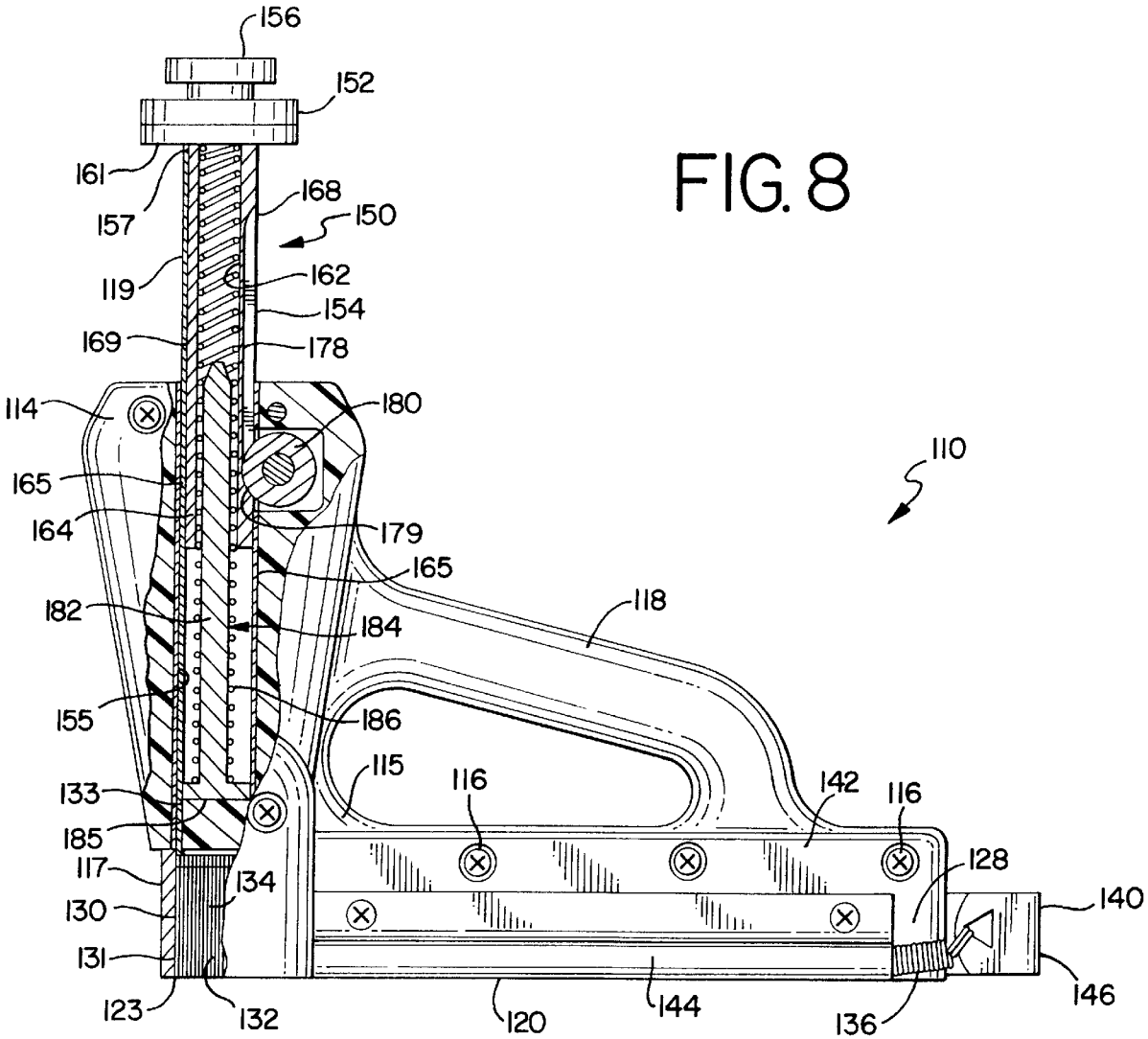

Turning to FIG. 8, an alternative embodiment of a nailer in accordance with the present invention is depicted. In FIG. 8, the last two digits of the 100 series of reference numbers correspond to like elements in FIGS. 1–7 having the same two digits in their reference numbers.

The nailer 110 of FIG. 8 has a planar bottom foot 120 for setting upon the planar surface of a workpiece. The operation of the nailer 110 is similar to that explained above with regard to FIGS. 1–7. However, fasteners are expelled from the nailer 110 so they are generally perpendicular to the nailer bottom foot 120 and the surface of the workpiece.

While the specific embodiments have been illustrated and described, numerous modifications come to mind without significantly departing from the spirit of the invention and the scope of protection is only limited by the scope of the accompanying claims.

What is claimed is:

1. A nailer for driving a fastener into a workpiece comprising:

a housing having a chamber adapted to receive at least one fastener;

a plunger operably connected to the housing and having a shank with a plurality of side surfaces with at least two of the side surfaces having a groove, respectively, and at least one of the other side surfaces, between the two grooved side surfaces, having a plurality of teeth;

a recoil resilient member operably connected to the housing and the plunger;

a pawl operably connected to the housing and received between at least two teeth of the plunger;

a resilient member operably connected to the pawl; and, a driving blade at least partially received within one of the grooves and the chamber.

2. The nailer of claim 1 wherein the housing includes a handle.

3. The nailer of claim 1 wherein the housing includes a foot adapted to set upon the workpiece.

4. The nailer of claim 3 wherein the foot includes a user removable plate member.

5. The nailer of claim 1 wherein the housing includes a magazine having a passage in fluid communication with the chamber.

6. The nailer of claim 5 wherein the passage receives a feeder bar resiliently coupled to the housing.

7. The nailer of claim 1 wherein the plunger includes a bore that receives at least a portion of the recoil resilient member.

8. The nailer of claim 7 wherein the bore in the plunger receives a support pin.

9. The nailer of claim 1 wherein at least one of the grooves receives a portion of a roller operably coupled to the housing.

10. A nailer for driving a fastener comprising:

a housing having a chamber that receives the fastener;

a plunger reciprocally mounted to the housing and having a striking surface and a shank with a plurality of side surfaces, at least two of the side surfaces having a groove and at least one of the other side surfaces, between the two grooved side surfaces, having a plurality of teeth;

a rachet operably coupled to the plunger; and, a driving blade at least partially received within one of the grooves and the chamber.

11. The nailer of claim 10 wherein the rachet includes a pawl that engages at least one of the teeth.

12. The nailer of claim 11 wherein a resilient member is operably coupled to the pawl.

13. The nailer of claim 10 wherein a resilient member is operably connected to the housing and the plunger.

14. The nailer of claim 13 wherein the plunger includes a bore that receives at least a portion of the resilient member.

15. The nailer of claim 14 wherein the bore in the plunger receives a support pin.

16. The nailer of claim 10 wherein the housing defines a handle.

17. The nailer of claim 10 wherein the housing includes a foot.

18. The nailer of claim 17 wherein the foot includes a user removable plate member.

19. The nailer of claim 10 wherein the housing includes a magazine having a passage in fluid communication with the chamber.

20. The nailer of claim 19 wherein the passage receives a feeder bar resiliently coupled to the housing.

21. A nailer for driving a fastener comprising:

a housing defining a handle and having a chamber that receives the fastener;

a plunger reciprocally mounted to the housing and having a surface suitable for striking with a mallet and a shank with a plurality of side surfaces, at least one of the side surfaces having a groove and at least one of the other side surfaces having a plurality of teeth perpendicular to the grooved surface;

a rachet operably coupled to the plunger; and, a driving blade in spaced parallel relationship to the grooved surface and at least partially received within the chamber.

22. The nailer of claim 21 wherein the rachet includes a pawl that engages at least one of a plurality of teeth and a resilient member is operably coupled to the pawl.

23. The nailer of claim 21 wherein a resilient member is operably connected to the housing and the plunger, and the plunger includes a bore that receives at least a portion of the resilient member and a support pin.

24. The nailer of claim 21 wherein the housing includes a magazine having a passage in fluid communication with the chamber.

* * * * *